US006328252B1

(12) United States Patent
Neveu et al.

(10) Patent No.: US 6,328,252 B1
(45) Date of Patent: Dec. 11, 2001

(54) DISPENSER OF PAPER SHEETS IN ROLL FORM WITH CENTRAL UNWINDING

(75) Inventors: Jean-Louis Neveu, Colmar; Philippe Guillemette, Caen, both of (FR)

(73) Assignee: Georgia Pacific France, Kunheim (FR)

( * ) Notice: Subject to any disclaimer, the term of this patent is extended or adjusted under 35 U.S.C. 154(b) by 0 days.

(21) Appl. No.: 09/613,306

(22) Filed: Jul. 10, 2000

(30) Foreign Application Priority Data

Jul. 8, 1999 (EP) ..... 99401705

(51) Int. Cl.[7] ..... B65H 49/38; B65H 1/00

(52) U.S. Cl. ..... 242/593; 242/615.3; 221/1; 221/62; 221/63

(58) Field of Search ..... 242/593, 132, 242/137, 146, 615.3, 615.4; 206/409, 390, 394, 205, 210, 812; 220/253; 221/63, 62, 1

(56) References Cited

U.S. PATENT DOCUMENTS 3,923,223 * 12/1975 Larsson et al. .
4,579,266 * 4/1986 Bunger et al. .
4,651,895 * 3/1987 Niske et al. .
4,905,868 * 3/1990 Beane et al. .
5,141,171 * 8/1992 Yang .
5,246,137 * 9/1993 Schutz et al. .
5,310,083 * 5/1994 Rizzuto .
5,765,718 * 6/1998 Grasso et al. .
6,129,240 * 10/2000 Morand .
6,145,782 * 11/2000 King et al. .

FOREIGN PATENT DOCUMENTS

2073931 * 1/1993 (CA) ..... 242/593
0836825A1 4/1998 (EP) .
956622 4/1964 (GB) .
2120639A 12/1983 (GB) .
WO9918835 4/1999 (WO) .

* cited by examiner

*Primary Examiner*—William A. Rivera
(74) *Attorney, Agent, or Firm*—Young & Thompson

(57) ABSTRACT

A dispenser of individual sheets by unwinding from the center of a product in roll form, without a central tube, having a plurality of successive sheets forming a coiled strip, a free end of which projects toward the outside of the roll from the center, of the type including a fixed dispensing nozzle which delimits a passage of frustoconical general shape and which includes a generally vertically oriented cutout to make it easier to introduce the free end of the strip of a roll into the passage, the width of the cutout in the vicinity of the upper orifice of the passage being markedly greater than its width in line with the lower outlet orifice of the nozzle.

11 Claims, 5 Drawing Sheets

DISPENSER OF PAPER SHEETS IN ROLL FORM WITH CENTRAL UNWINDING

BACKGROUND OF THE INVENTION

The present invention relates to a dispenser of individual paper sheets.

The invention relates, in particular, to a dispenser enabling its user to take one or more sheets in succession by unwinding from the center of a product in roll form, which has no central tube or core and which consists of a plurality of successive sheets forming a coiled strip, a free end of which projects toward the outside of the roll from the center of said roll.

DESCRIPTION OF THE RELATED ART

Such a dispenser is used, in particular, for obtaining multiple-use absorbent paper sheets based on cellulose wadding.

The paper takes the form of a coiled strip, from which the successive sheets are to be dispensed.

For this purpose, a first technique involves providing, at the outlet of the dispenser, means which partially block the unwinding of the strip under the effect of the pull applied to the latter by the user, by means, the lower edge of which is cutting or in the form of sawteeth, so as to form sheets by tearing off and/or cutting off from a continuous strip.

According to another technique, the strip in roll form is precut, that is to say it comprises uniform partial cuts corresponding to consecutive sheets usually of the same length, and, here again, the dispenser comprises, in its lower part, means through which the precut paper strip passes, said means gripping the latter so as to enable the user to separate the sheet which is extracted from the dispenser from the following sheet by exerting a sudden additional pull in order to separate it along the precut line.

A dispenser has already been proposed for this purpose, of the type comprising:

- a dispenser housing comprising a fixed first part and a moveable second part mounted in an articulated manner relative to the fixed part between an open position for reloading the dispenser and a closed position, in which said second part delimits, with the first part, an upper receptacle for storing in a vertical position the roll to be unwound;
- a lower plate which is carried by the fixed part of the housing and which supports vertically a lower axial end of the roll and comprises a hole for the passage of the strip;
- and a fixed dispensing nozzle which is arranged below the support plate and which delimits a downwardly convergent passage of frustoconical general shape, the upper inlet orifice of which is substantially in the extension of the hole in the support plate, so as to guide the strip toward its lower outlet orifice of reduced diameter, and which comprises a generally vertically oriented cutout in the general form of a slot, which extends between the upper inlet and lower outlet orifices, in order to make it easier for the free end of the strip of a roll to be introduced into the passage of the dispensing nozzle.

A first example of such a dispenser is described and illustrated in the document EP-A-0,740,921, in which the element for closing the cutout of the dispensing nozzle is produced in one piece with the lower part of the moveable second part of the housing and in which the cutout is a narrow vertical slot with parallel edges, which issues vertically upward and downward into the upper inlet and lower outlet orifices of the passage formed in the body of the dispensing nozzle.

Such a design has many disadvantages.

First of all, the slot is narrow and it is difficult to introduce the free end portion of the strip of a new roll or of a partially unwound roll, without damaging the strip, in as much as the slot is narrow and in as much as it is necessary to keep the moveable second part of the housing in the high position.

Moreover, when the housing is being closed as a result of the vertically downward tilting of its moveable second part, the closing of the cutout by the closing element integrated into the moveable part of the housing takes place "blind", that is to say there is a considerable risk that the person responsible for replacing the roll will jam the strip in the introduction slot by means of the closing element.

Moreover, it is found, during use, that the paper strip which passes through the passage in the nozzle rubs continuously against that part of the inner wall of the convergent passage which is cut out and completed by the closing element, that is to say the strip rubs against a wall which is not perfectly smooth and continuous, with the considerable risk that the paper strip will be damaged if the two pieces do not have the perfect fit.

Another example of such a dispenser according to the prior art is described and illustrated in the American patent application number U.S. Ser. No. 81732,014 filed on Oct. 16 1996.

The design proposed in this document is substantially similar to that described and analyzed above, except that the axis of articulation of the moveable second part of the housing is a vertical axis.

This design has most of the disadvantages mentioned above in respect of that described and illustrated in the document EP-A-0,740,921.

SUMMARY OF THE INVENTION

In order to overcome these disadvantages, the invention proposes a dispenser of the type mentioned above, defined in that the width of the cutout in the vicinity of the upper orifice is clearly greater than its width in line with the lower outlet orifice into which it issues vertically downward, so as to make it possible to introduce said free end of the strip vertically from the bottom upward through the cutout and then radially toward the axis of the dispensing nozzle.

According to other characteristics of the invention:

- the cutout is formed in a part of the passage which is located toward a rear vertical bottom of the fixed part of the housing, by means of which bottom the latter is fastened to a wall or to a support, in such a way that, during use, that portion of the strip which passes vertically through the dispensing nozzle cooperates with a portion, not cut out, of the inner wall of the passage;
- the dispensing nozzle comprises an element for closing the cutout, which has a shape complementary to that of the latter and which is mounted in an articulated manner relative to the body of the dispensing nozzle between a position of use, in which the cutout is closed and in which the passage is delimited by a continuous inner wall, and a reloading position, in which said closing element is retracted in order to release the cutout for the purpose of introducing the free end of the strip;
- the element for closing the cutout is mounted in an articulated manner relative to the body of the dispensing nozzle about a horizontal upper axis located vertically substantially in is line with the upper inlet orifice of the dispensing nozzle, and the element for closing the cutout is mounted tiltably between a high position of use and a low reloading position;

the axis of articulation of the element for closing the cutout is offset radially outward relative to that portion of the edge of the upper inlet orifice of the passage which said closing element comprises, so as to cause the element for closing the cutout to tilt by gravity from its high position of use toward its low reloading position;

the dispenser comprises means for the automatic locking of the element for closing the cutout in the position of use;

the means for the automatic locking of the element for closing the cutout comprise an elastically deformable automatic locking tab which comprises a catching nose which cooperates with a complementary notch in the support plate of the roll;

the means for the automatic locking of the element for closing the cutout comprise a locking and positioning finger which is arranged at the lower free end of the element for closing the cutout and which, in the position of use, is received in a complementary receptacle of the body of the dispensing nozzle;

the fixed first part of the housing comprises a perforated lower horizontal bottom, through which the dispensing nozzle extends vertically downward, so as to give access, from outside the housing, to the element for closing the cutout, for the purpose of manipulating said closing element between its position of use and its reloading position;

the body of the dispensing nozzle is fastened under the lower face of the support plate of the roll, so as to form a subassembly which bears vertically downward, with the outer periphery of the support plate, against a confronting portion of the upper face of the horizontal bottom of the fixed first part of the housing;

the body of the dispensing nozzle comprises, at its peripheral upper end, means of the bayonet type for mounting it and fastening it under the lower face of the support plate of the roll;

the fixed first part of the housing comprises a rear vertical fastening plate and a lower horizontal bottom, and all the other walls of the housing belong to the moveable second part of the housing, said second part being mounted in an articulated manner on the fixed first part of the housing about a horizontal axis of articulation arranged in the lower part of the housing.

BRIEF DESCRIPTION OF THE DRAWINGS

Other characteristics and advantages of the invention will be gathered from a reading of the following detailed description, to understand which reference will be made to the accompanying drawings in which.

DESCRIPTION OF THE PREFERRED EMBODIMENT

In the following description, the terms vertical, horizontal, upper, lower, front, rear, etc. will be used with reference to the Figures in order to make it easier to understand the description, but in a meaning which does not limit the invention.

Figure 1:
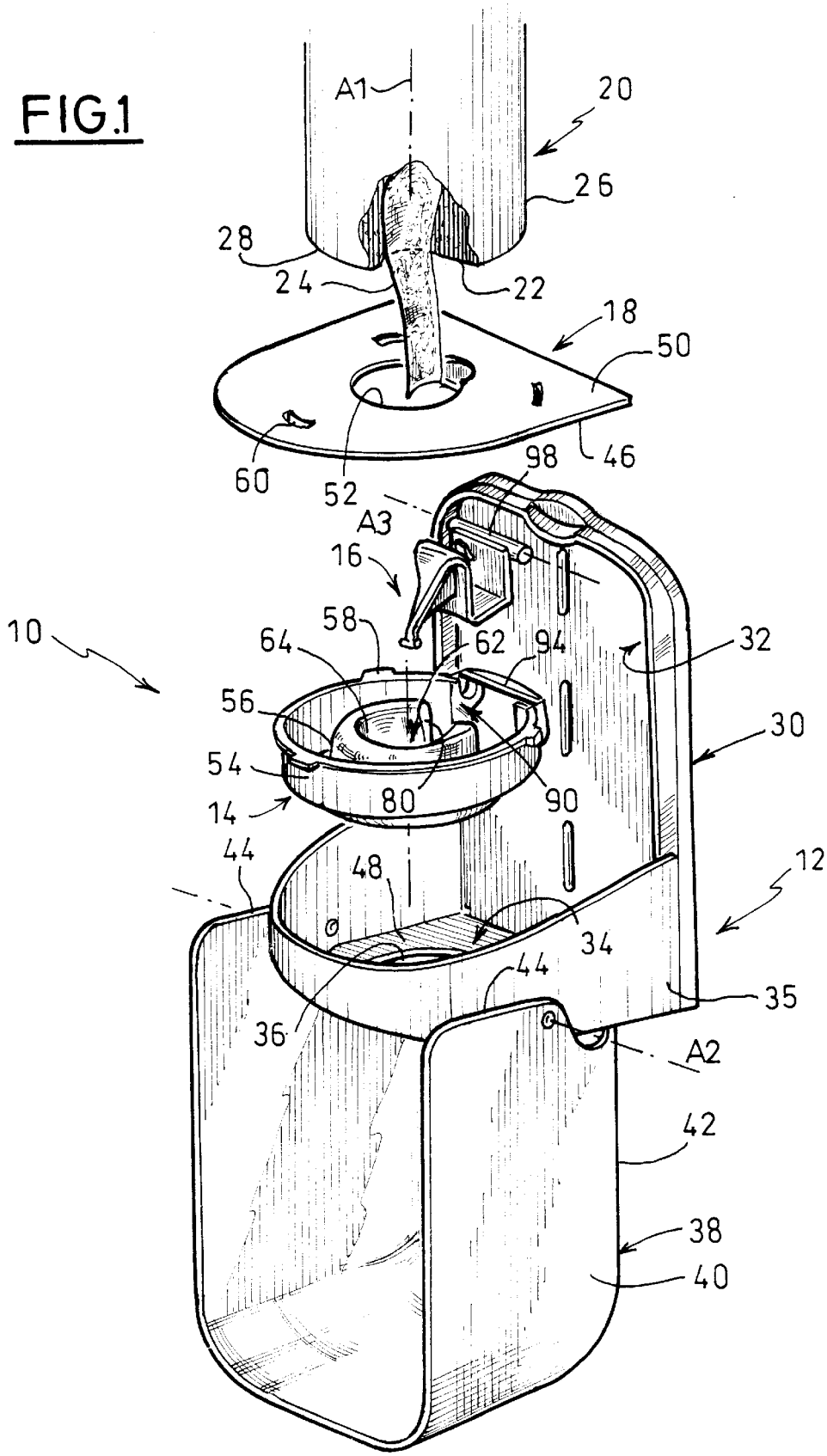
FIG. 1 is an exploded perspective view of the main components of a dispenser according to the invention, with the moveable part of the housing forming a closing cover and illustrated in the open reloading position.

The dispenser 10 according to the invention, illustrated particularly in FIG. 1, consists essentially of a housing 12, of an intermediate piece 14 comprising the dispensing nozzle and assigned to an element 16 for closing the cutout of the latter, and of a plate 18 which is intended for supporting a roll 20.

The function of the dispenser 10 is, in fact, to allow the progressive unwinding of the roll 20 which, here, is a roll consisting of a strip 22 of cellulose wadding which is coiled about a vertical general axis A1.

The center of the roll does not have a tube or a central tube, that is to say consists of a vertically oriented central hole, via which the inner free end 24 of the strip 22 emerges, here vertically downward.

The roll 20 is delimited by a cylindrical outer lateral surface 26 and by two transverse end faces, one of which is a horizontal lower transverse face 28 of annular general shape which can be seen in FIG. 1.

The housing 12 takes the form of two parts produced from plastic by injection molding.

A fixed first part 30 consists essentially of a rear vertical plate 32 and of a horizontal lower plate 34 forming a horizontal bottom which is perforated centrally by a substantially circular hole of large dimension 36.

The fixed part 30 makes it possible, by means not illustrated, to fasten the housing 12 to a wall or to a column by means of the rear vertical plate 32, and the fixed part 30 also comprises a lower lateral wall portion 35 in the form of an arc of a cylinder of low height.

The housing 12 also comprises a moveable second part 38 which forms a closing cover and which consists essentially of a U-shaped lateral wall 40 and of a front transverse wall oriented vertically in the closed position of the lid 42.

The moveable part forming a cover 38 is mounted in an articulated manner on the fixed part 12 about a horizontal axis of articulation A2 which is arranged in the vicinity of the bottom 34 of the fixed part 12 and in the vicinity of the horizontal lower edges 44 of the lateral wall 40.

As can be seen in FIG. 1, with the cover 38 in the open position, the latter extends vertically completely below the fixed part 12, at the same time completely freeing the upper part of the housing, without obstructing the surroundings of the latter.

Means, not illustrated, are, of course, provided for locking the cover 38 in the closed upper position, in which its lateral wall 40 and its front face 42 cooperate with the rear transverse wall 32 and the bottom 34 in order to delimit a closed containment, in which, in particular, the roll 20 is received.

The plate 18 has a peripheral contour of a shape complementary to that of the horizontal bottom 34 of the housing 12, and said plate is dimensioned so as to be capable of being received in the housing 12, with the outer peripheral part of its lower face 46 bearing vertically against the upper face 48 of the bottom 34, the two faces 46 and 48 being in mutual bearing contact by gravity when the support plate is in place in the bottom of the housing 12.

The support plate 18 has a smooth upper face 50, on which the roll 20 bears with its face 28, and said support plate is perforated centrally, that is to say it comprises a central hole of substantially circular contour 52 for the passage of the free end 24 of the strip 22 of the roll 20 through the hole 52.

The dispensing nozzle 14 is a plastic injection molding of a general shape of revolution about the vertical axis A1.

It comprises a peripheral cylindrical annular skirt 54, of which the upper edge which is in the form of a horizontal rim 56 comprises, here, three radial detents 58 which belong to means of the bayonet type for fastening the nozzle 14 under the support plate 18, these means comprising, furthermore, complementary notches 60 formed under the lower face 46 of the plate 18.

Figure 2:
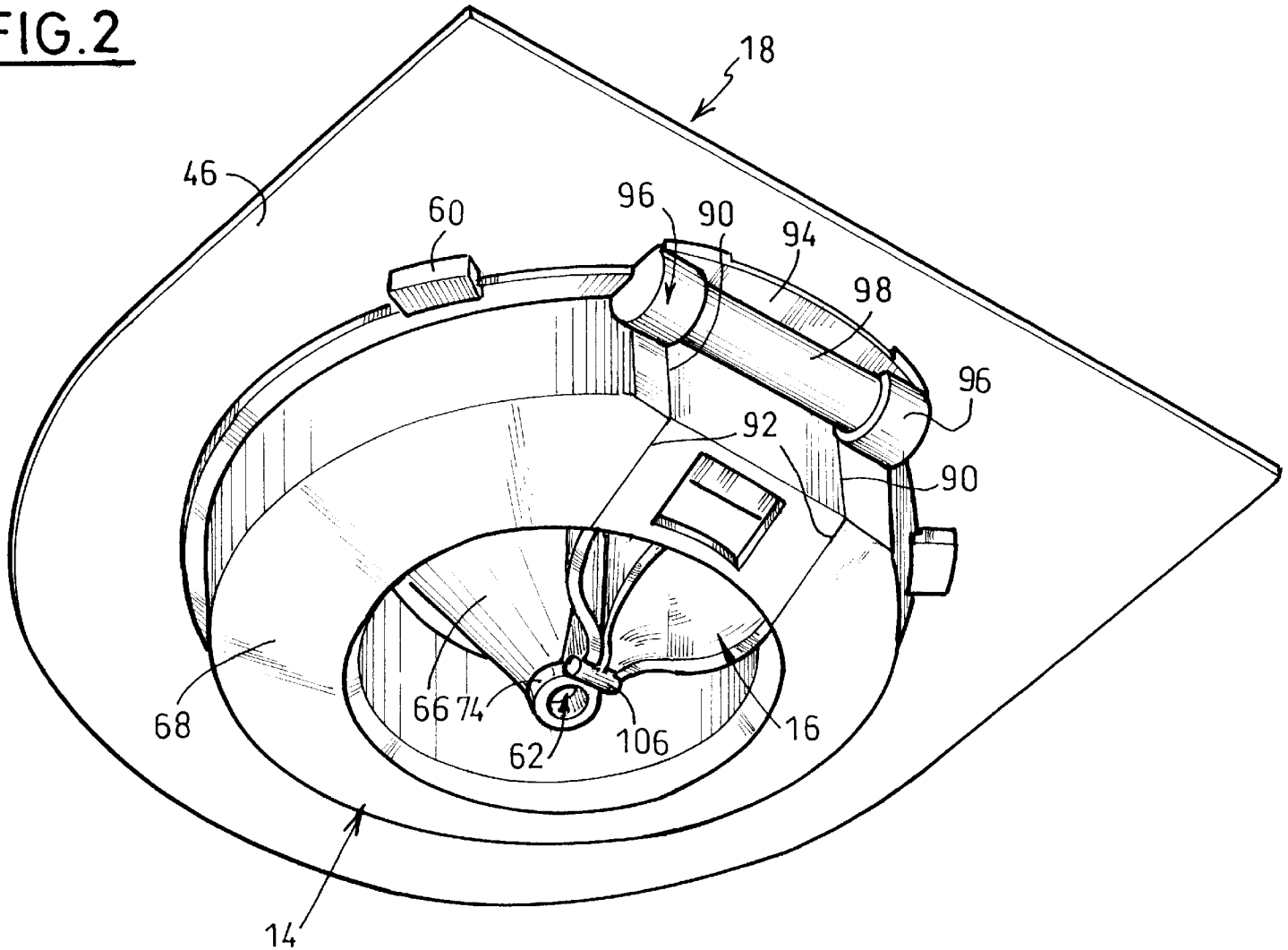
FIG. 2 is a perspective bottom view, on a larger scale, which illustrates the subassembly consisting of the support plate and the dispensing nozzle, with the element for closing the cutout of the latter, said closing element being illustrated as being locked in the high position of use.
Figure 3:
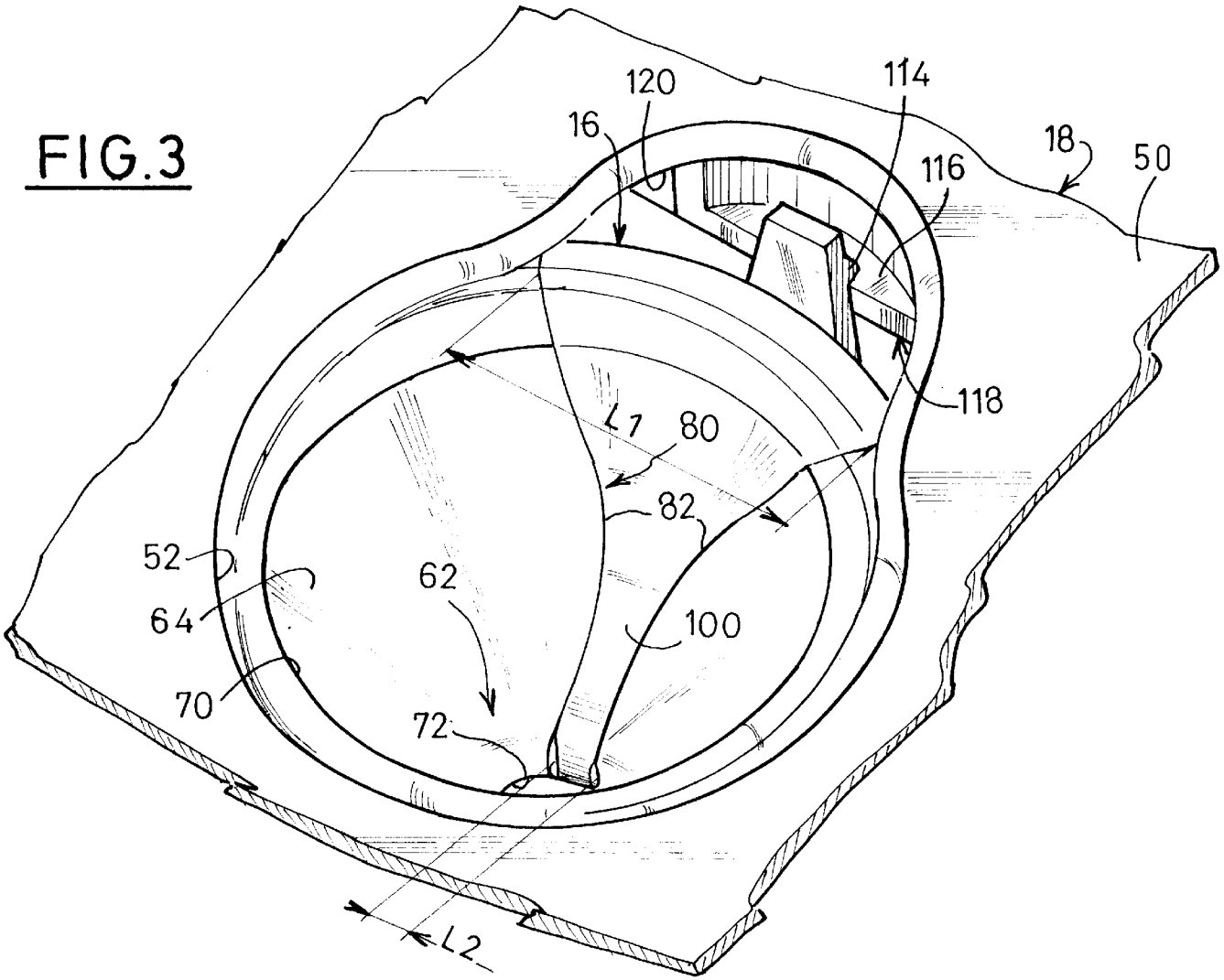
FIG. 3 is a partial view, similar to that of FIG. 2, in which the subassembly is illustrated in a perspective top view, that is to say from inside the dispensing nozzle.

By virtue of being assembled by the means of the bayonet type, the body of the nozzle 14 and the plate 18 form a subassembly, illustrated particularly in FIGS. 2 and 3, which is put in place in the housing 12, the dispensing nozzle 14 then extending vertically downward through the cutout 36 beyond the bottom 34 of the housing 12.

The nozzle 14 comprises, in a known general way, a central passage 62 of frustoconical general shape convergent with a vertically downward orientation.

More specifically, the passage 62 consists of the inner wall 64 of a central part in the form of a frustoconical dish 66 which is connected to the skirt 54 by means of a connecting ring 68.

The passage 62 is delimited at its upper end by a circular upper orifice formed by an edge 70 and at its lower end by a lower outlet orifice 72 formed by the cylindrical wall of a lower free end portion 74 of cylindrical shape of the dish 66.

According to a known general arrangement, the diameter of the lower outlet orifice 72 is markedly smaller than the large diameter of the upper inlet orifice 70, so that the strip 24 which passes through the passage 62 is contracted progressively by the convergent concave frustoconical wall 64, so that the whole of the strip is gripped radially toward the axis Al in the region of the lower orifice 72.

According to the invention, the inner concave wall 64 of the passage 62 is not complete, that is to say it comprises a cutout 80 in the general form of a slot.

According to one aspect of the invention, the cutout or slot 80 does not have parallel edges, that is to say it is delimited by two opposite edges 82 which widen vertically from the bottom upward and radially from the inside outward.

Figure 6:
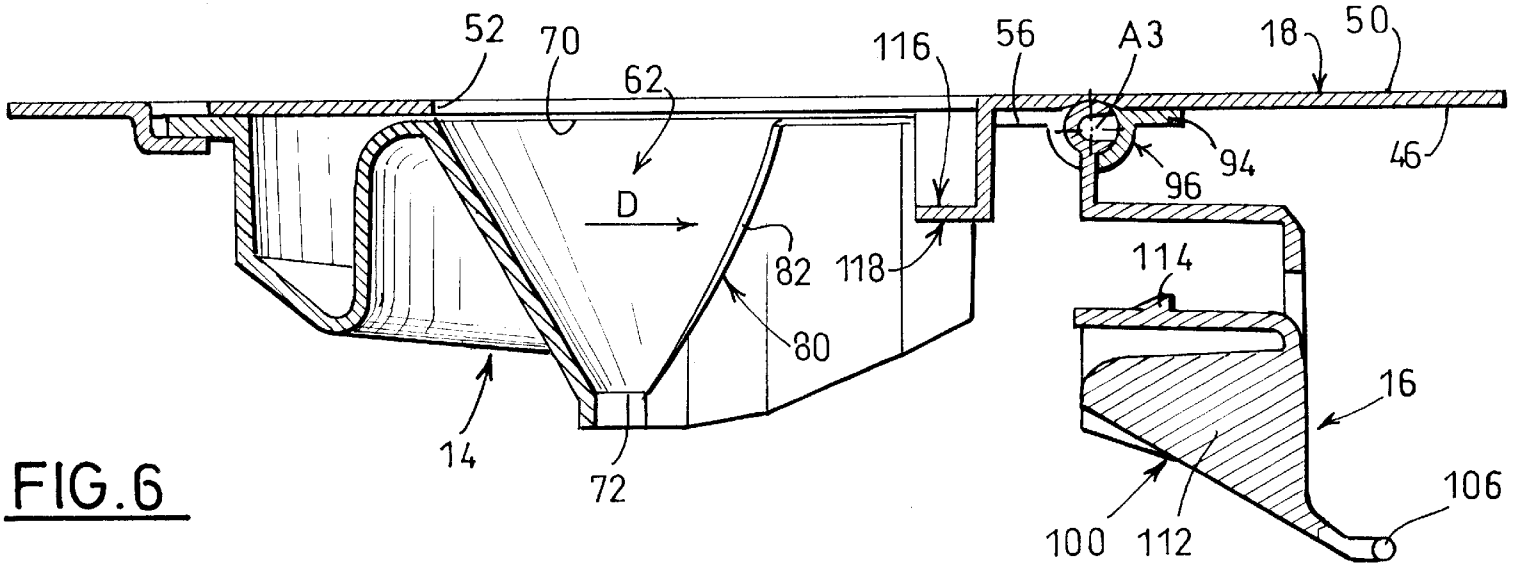

Thus, whether in a top view along the axis A1 or in a side view in the direction "D" of FIG. 6, the projection of the cutout 80 delimited by the edges 82 has a substantially triangular profile.

Thus, the circumferential extent or width L1 of the slot 80 separating its two opposite edges 82 at the upper orifice 70 has a dimension markedly greater than its width L2 at the lower end of the slot 80, that is to say at the lower orifice 72.

As can be seen in the Figures, the slot or cutout 80 issues vertically downward.

The shaping as a triangle and the dimensioning of the cutout 80 are such that it is possible to cause the strip 24 to pass through the cutout 80 vertically from the top downward, without gripping it or compressing it radially, then to introduce it into the passage 62 and, in particular, into the lower orifice 72, then introducing it radially in the direction of the axis Al into the cutout.

By virtue of the design according to the invention, it is possible to put the roll 20 in place on the support plate 18, then close the housing 12 and subsequently pull the strip 24 through the cutout 80 so as to cause it to pass vertically from the bottom upward into the cutout, and introduce it into the passage 62, this taking place from the lower face of the housing 12 through which, as a result of the cutout 36, the dispensing nozzle 14 extends vertically downward.

According to one characteristic of the invention, the cutout 82 is oriented in a vertical plane perpendicular to the plane of the rear plate 32 of the housing 12, that is to say the cutout 80 is formed in the rear part of the passage 62, said rear part facing the wall.

During use, when a consumer pulls on the free end 24 of the strip 22 of the roll 20, said free end passing through the passage 62, he does this forward, that is to say toward him, or slightly laterally, but never rearward. Thus, the strip 24 is always in frictional contact with the convergent concave inner wall 64 of the dispensing nozzle 14, that is to say with a continuous surface without a cutout, while the cut-out part is on the opposite side toward the rear.

Thus, for the entire length of the pull, the tissue or paper 24 is in contact with a perfectly smooth surface which is not liable to damage it.

According to another aspect of the invention, a closing element 16 is provided for completing the passage 62 of the cutout in the position of use.

The closing element 16 is an element which is attached to the dispensing nozzle 14 and which is produced in the form of a plastic injection molding of a shape substantially complementary to that of the nozzle 14.

The piece 16 for closing the cutout 80 is mounted in an articulated manner relative to the body of the dispensing nozzle 14 about a horizontal axis of articulation A3 which is parallel to the plane of the vertical bottom 32 of the housing 12, that is to say perpendicular to the mean vertical plane of the cutout 80.

As can be seen in the Figures, the cutout 80, in addition to its function as an introduction slot formed in the wall 64 of the passage 62, is extended in a complementary cutout formed in the skirt 54 and the ring 68 which are cut out with a vertically oriented recess having parallel edges 90 and 92.

In order to impart sufficient rigidity to the body of the nozzle 14, the edges 90 of the cutout are connected to one another by means of an upper crossmember 94 which extends in the same plane as the edge 56.

The crossmember 94 comprises, in its lower part, a hollow semicylinder 96 open vertically upward and forming a receptacle for a horizontal rod 98 belonging to the closing element 16 and forming the means of articulation of the latter relative to the nozzle 14, about the axis A3.

More specifically, the receptacle 96 consists of two half receptacles which are arranged laterally opposite one another and each of which receives one lateral end of the rod 98, thus forming two articulation pins.

Figure 5:
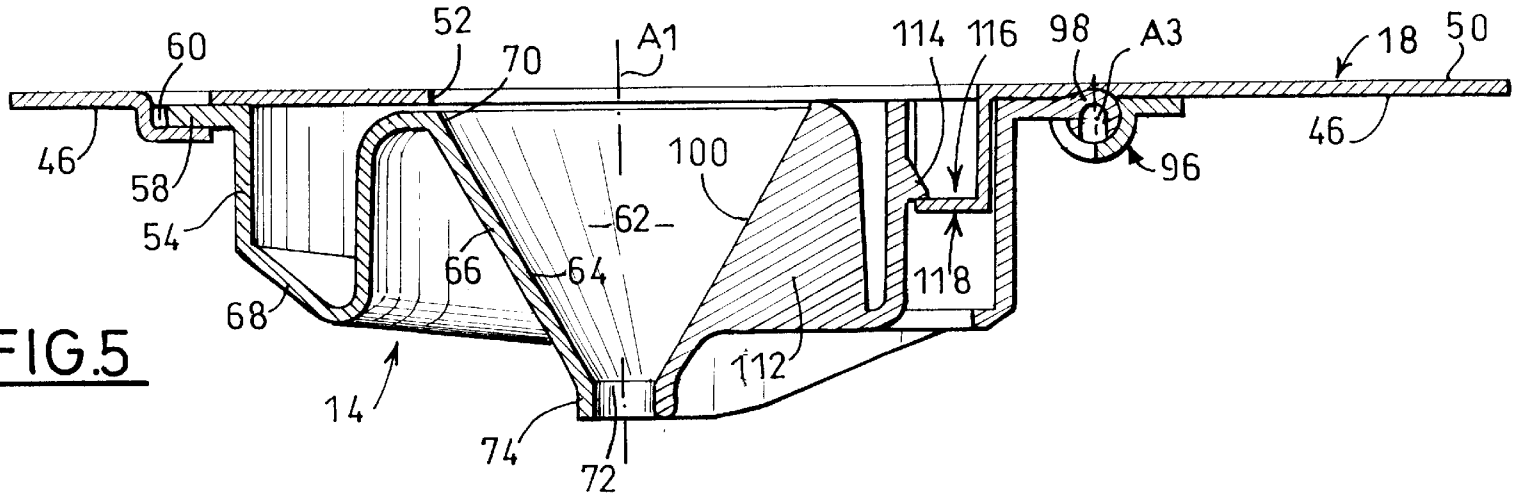
FIGS. 5 and 6 are views in vertical section in a plane perpendicular to the axis of articulation of the element for closing is the cutout, which show the subassembly illustrated respectively in FIGS. 2 and 4.

The element 16 for closing the cutout 80 comprises an active main portion 100 which has a profile complementary to that of the dish 66 and which is delimited laterally by two opposite lateral edges 102 complementary to the edges 82 of the cutout 80, in such a way that, in the high position of use illustrated in FIGS. 2, 3 and 5, this active portion 100 forms the complement to the dish 66 so as to reconstruct a passage 62 in the form of a complete piece or dish of revolution 66, this being so as to prevent any accidental escape of the strip 24 out of the passage 62 via the cutout 80.

Figure 4:
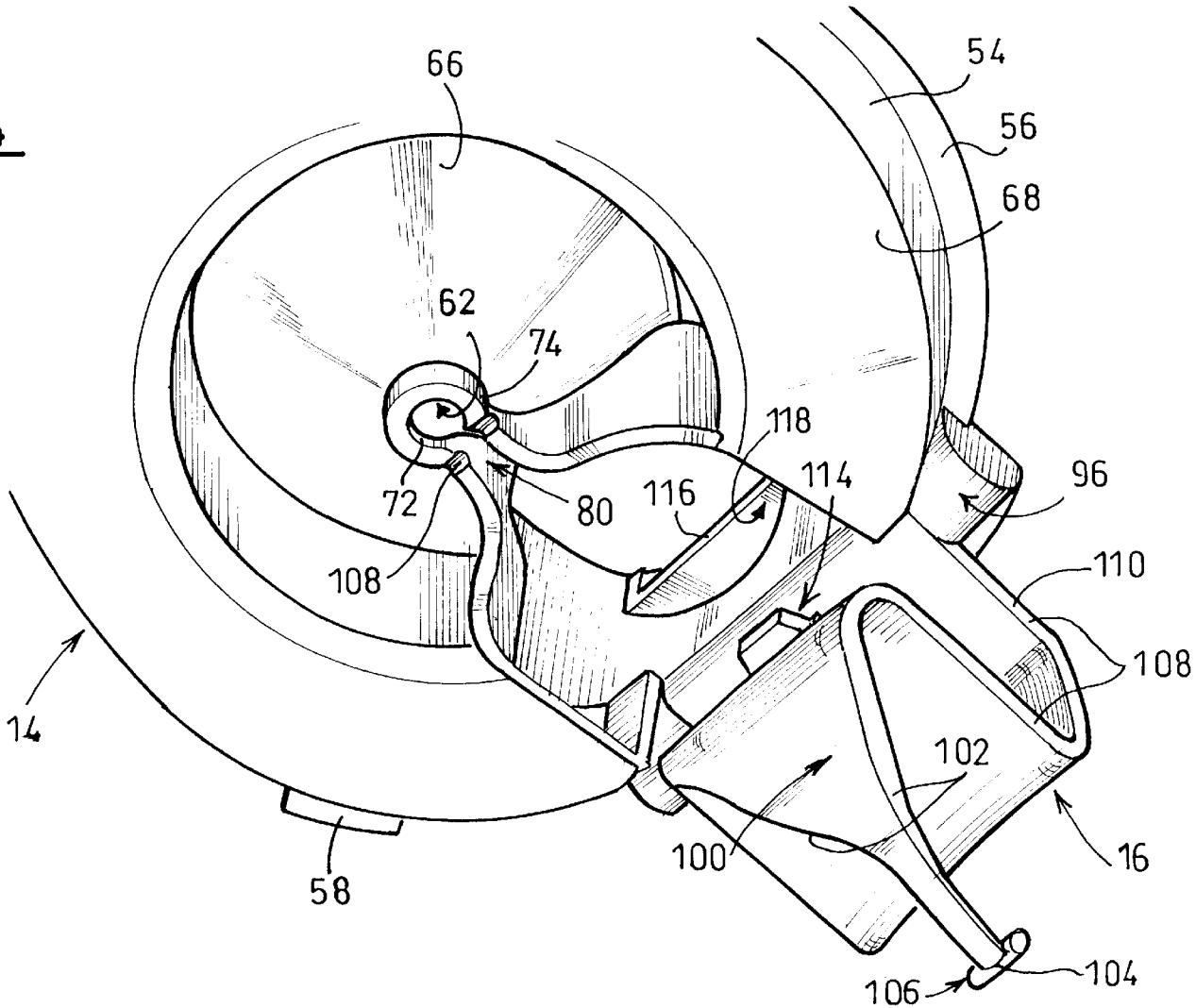
FIG. 4 is a perspective bottom view of the dispensing nozzle with the element for closing the cutout of the latter, said closing element being illustrated in the low reloading position.

At its lower free end 104 of small width, the main portion 100 comprises a locking and positioning finger 106 which, in the high position of use, is received in two complementary semicylindrical receptacles 108 formed in the lower face of the dish 66 in the vicinity of the cylindrical part 74 (see FIGS. 2 and 4).

In order to connect the portion 100 of the closing element 16 to its articulation rod 98, said portion is extended by two ring sections 108 and by a cylindrical skirt section 110 which are respectively complementary to the rings 68 of the skirt 54 of the body of the nozzle 14.

A reinforcing rib 112, which extends in a vertical plane, connects the active portion 100 to the immediately adjacent ring section which comprises, at its upper end, a finger 114 for the automatic locking of the closing element 16, said finger being received, in the position of use and as may be seen particularly in FIG. 5, in a complementary receptacle 116 formed by a cup 118 produced integrally with the support plate 18 by injection molding.

The rib 112 also has an ergonomic shape to make it easier to close the element 16.

The locking finger 114, in the form of a locking nose, is chamfered in such a way that it is locked automatically during the closing movement of the closing element 16, that is to say when the latter is pivoted clockwise from the position which it occupies in FIG. 6 into the position which it occupies in FIG. 5.

In order to have access to the locking means consisting of the nose 114, for the purpose of allowing the closing element 16 to tilt counterclockwise about its axis A3, as seen in FIG. 5, the hole 52 of substantially circular contour in the support plate 18 comprises, toward the rear, a clearance 120 which, after the housing 12 has been opened, makes it possible to release the notch 114 so as to cause the opening of the closing element 16 which pivots automatically about the axis A3 by gravity.

This automatic pivoting is obtained by virtue of the fact that the axis A3 is offset radially outward, while its principal mass and therefore its center of gravity are offset radially inward in the direction of the axis A1.

The closing and automatic locking of the element 16 can be carried out from outside the closed housing, that is to say below the latter, while still having a visual check of the correct position of the free end of the strip 24 in the passage 22 before the closing of the element and during the closing operation, that is to say without the risk of jamming the strip 24 between the cutout 80 and the active functional part 100 of the closing element 16.

Designing in the form of a subassembly the plate 18 and the nozzle 14 which carries its articulated closing element 16 makes it possible to use the same housing 12 with the cutout 36 in its horizontal bottom 34 for another type of dispenser, that is to say, for example, by replacing the subassembly 14–18 by an element comprising an outlet passage convergent vertically downward, with means for cutting the sheet at the periphery of the lower outlet orifice of this passage, for example provided with sawteeth.

What is claimed is:

1. A dispenser (10) of individual sheets by unwinding from the center of a product in roll form (20), without a central tube, consisting of a plurality of successive sheets forming a coiled strip (22), a free end (24) of which projects toward the outside of the roll from said center, comprising:

a dispenser housing (3) comprising a fixed first part (32) and a moveable second part (38) mounted in an articulated manner relative to the fixed part between an open position for reloading the dispenser and a closed position, in which said second part delimits, with the first part (30), an upper receptacle for storing in a vertical position the roll to be unwound;

a lower support plate (18) which is carried by the fixed part (30) of the housing and which supports vertically a lower axial end of the roll and comprises a hole (52) for the passage of the strip (22, 24);

and a fixed dispensing nozzle (14) which is arranged below the lower support plate and which delimits a downwardly convergent passage (62) of frustoconical general shape, an upper inlet orifice (70) of which is substantially in the extension of the hole (52) in the lower support plate, so as to guide the strip (22, 24) toward a lower outlet orifice (72) of reduced diameter, and which comprises a generally vertically oriented cutout (80) in the general form of a slot, which extends between the upper inlet (70) and lower outlet (72) orifices, in order to make it easier for the free end (24) of the strip of a roll to be introduced into the passage (62) of the dispensing nozzle (41);

wherein the width (11) of the cutout (80) at the upper inlet orifice (70) is markedly greater than its width (L2) in line with the lower outlet orifice (72), into which said cutout issues vertically downward, so as to make it possible to introduce the free end (24) of the trip (22) vertically from the bottom upward through the cutout (80) and then radially toward the axis (A1) of the dispensing nozzle (14), the cutout (80) is formed in a part of the passage which is located toward a rear vertical bottom (32) of the fixed part (30) of the housing (12), by means of which bottom the housing is fastened to a wall or to a support, in such a way that, during use, that portion of the strip which passes vertically through the dispensing nozzle (14) cooperates with a portion of the inner wall (64) of the passage (62).

2. The dispenser as claimed in claim 1, wherein the dispensing nozzle (14) comprises an element (16) for closing the cutout (80), which has a shape complementary to that of the cutout and which is mounted in an articulated manner (A3) relative to the body of the dispensing nozzle (14) between a position of use, in which the cutout (80) is closed and in which the passage (62) is delimited by a continuous inner wall, and a reloading position, in which said closing element is retracted in order to release the cutout (80) for the purpose of introducing the free end (24) of the strip (22).

3. The dispenser as claimed in claim 2, wherein the element (16) for closing the cutout (80) is mounted in an articulated manner relative to the body of the dispensing nozzle (14) about a horizontal upper axis (A3) located vertically substantially in line with the upper inlet orifice (70) of the dispensing nozzle, and wherein the element (16) for closing the cutout (80) is mounted tiltably between a high position of use and a low reloading position.

4. The dispenser as claimed in claim 3, wherein the axis (A3) of articulation of the element (16) for closing the cutout (80) is offset radially outward relative to that portion of the edge of the upper inlet orifice of the passage which said closing element comprises, so as to cause the element for closing the cutout to tilt by gravity from its high position of use toward it low reloading position.

5. The dispenser as claimed in claim 2, which comprises means (106, 108, 114, 116) for the automatic locking of the element (16) for closing the cutout in the position of use.

6. The dispenser as claimed in claim 5, wherein said means for the automatic locking of the element (16) for closing the cutout (80) comprise an elastically deformable automatic locking tab which comprises a catching nose (114) which cooperates with a complementary notch (116, 118) in the support plate (18) of the roll (20).

7. The dispenser as claimed in claim 5, wherein the means for the automatic locking of the element for closing the cutout comprise a locking and positioning finger (106) which is arranged at the lower free end of the element (16, 100) for closing the cutout (80) and which, in the position of use, is received in a complementary receptacle (108) of the body (66, 74) of the dispensing nozzle (14).

8. The dispenser as claimed in claim 2, wherein the fixed first part (30) of the housing comprises a perforated (36) lower horizontal bottom (34), through which the dispensing nozzle (14) extends vertically downward, so as to give access, from outside the housing, to the element (16) for closing the cutout (80), for the purpose of manipulating said closing element between its position of use and its reloading position.

9. The dispenser as claimed in claim 8, wherein the body of the dispensing nozzle (14) is fastened under the lower face (46) of the support plate (18) of the roll (20), so as to form a subassembly which bears vertically downward, with the outer periphery of the support plate, against a confronting portion of the upper face (48) of the horizontal bottom (34) of the fixed first part (30) of the housing.

10. The dispenser as claimed in claim 9, wherein the body of the dispensing nozzle comprises, at its peripheral upper end, means of the bayonet type for mounting it and fastening it under the lower face (46) of the support plate (18) of the roll (20).

11. The dispenser as claimed in claim 1, wherein the fixed first part of the housing (30) comprises a rear vertical fastening plate (32) and a lower horizontal bottom (34), and wherein all the other walls (40, 42) of the housing belong to the moveable second part (38) of the housing, said second part being mounted in an articulated manner on the fixed first part of the housing about a horizontal axis of articulation (A2) arranged in the lower part of the housing.

* * * * *